US005832823A

United States Patent [19]

Shiba et al.

[11] Patent Number: 5,832,823

[45] Date of Patent: Nov. 10, 1998

[54] ROTARY PRESS

[75] Inventors: Noriyuki Shiba; Yuko Tomita, both of Tokyo, Japan

[73] Assignee: Kabushiki Kaisha Tokyo Kikai Seisakusho, Japan

[21] Appl. No.: 867,794

[22] Filed: Jun. 3, 1997

[30] Foreign Application Priority Data

Nov. 29, 1996 [JP] Japan ..... 8-319353

[51] Int. Cl.[6] ..... B41F 5/06; B41F 13/02

[52] U.S. Cl. ..... 101/181

[58] Field of Search ..... 101/228, 219, 101/181, 225, 227, 138, 139, 143, 176, 178, 179–182, 177; 242/555.5, 555.6, 555.7, 550, 551

[56] References Cited

U.S. PATENT DOCUMENTS 2,147,617 2/1939 Cleery ..... 242/555.5
3,761,001 9/1973 Bolza-Schunemann ..... 101/181 X

FOREIGN PATENT DOCUMENTS 3-70935 7/1991 Japan .
7-19791 5/1995 Japan .

*Primary Examiner*—J. Reed Fisher
*Attorney, Agent, or Firm*—Ronald P. Kananen; Rader, Fishman & Grauer

[57] ABSTRACT

In order to enable a rotary press having a plurality of printing units capable of printing on a paper web drawn out of a roller sheet of paper to operate in an increased working efficiency, to be saved in space and to be small sized, there is provided a construction thereof in which a space is provided which is substantially identical to a space that is required to accommodate a single roll of paper of a predetermined diameter, in each of one half or less (3) of the said plurality of printing units; a means (30) is provided for supporting, in the said substantially identical space, a plurality of rolls of paper (W21, W22) each with a diameter that is smaller than the said predetermined diameter, the said means being operable so that the said plurality of rolls of paper may be joined together in succession automatically; and further there is provided, in the said substantially identical space and at a site that is adjacent thereto, a means (50) supported on the said supporting means (30) for joining the said plurality of rolls of paper together in succession automatically.

2 Claims, 3 Drawing Sheets

ROTARY PRESS

SPECIFICATION

1. Technical Field

The present invention relates to a rotary press having a plurality of printing units each of which is capable of printing with a printing cylinder on a paper web that is drawn out of a single roll of paper, e.g., a fresh roll of paper, of a given diameter supported on a frame on which the above mentioned printing cylinder is mounted.

2. Background Art

As a printing unit as mentioned above there has been known, for example, what constitutes the second printing means of a rotary press as disclosed in Japanese Examined Utility Model Publication No. Hei 7-19791. There has also been disclosed in Japanese Unexamined Utility Model Publication No. Hei 3-70935 throughout its specification a rotary press having a plurality of printing units and a plurality of paper feed units which are separately provided from the printing units, in which a part of the paper feed units can be furnished with a fresh roll of paper and may individually constitute a paper feed unit equipped with an automatic paper joining unit whereas the rest of the paper feed units may be furnished with only a single fresh roll of paper and may constitute a paper feed unit not equipped with an automatic paper joining unit.

A printing unit as shown in the former (Japanese Examined Utility Model Publication No. 7-19791) of the above mentioned techniques in the prior art has a paper feed mechanism and a printing Mechanism compactly assembled and hence is advantageous in respect of its ability to be installed in a small area of installation. Also, because of its ability for the paper feed mechanism to be furnished with a fresh roll of paper, a rotary press may be constructed that is equipped with a plurality of such printing units, which is extremely advantageous in providing a printing number of printed matters that is small per a production lot, e.g. an employee magazine, a town magazine, a trade paper or a local newspaper in a small number of publications. In addition, since the paper feed mechanism and the printing mechanism have a common frame, the above mentioned rotary press is much inexpensive and may reduce the cost of installation as compared with a conventional rotary press in which the said two mechanisms are mounted on their respective frames and in which a plurality of separately arranged printing and paper feed units are required. Thus, with these advantages coupled together, a demand for the said improved rotary press has been more and more increased in recent years.

It has been noted, however, that this rotary press with a plurality of printing units as shown in the former publication in the prior art has a number of disadvantages arising from the fact that the paper feed mechanism of each of the printing units can only be supplied with a single roll of paper. Thus, in a case where after the termination of a given production printing lot another production printing lot is to be performed with the remaining roll of paper, such a roll of paper may have been used up before a required printing number is reached. Then, each time such occurs, the rotary press will have to be stopped to replenish it with a new roll of paper, thus lowering the working efficiency of the rotary press.

Also, in an attempt to prevent such a drop in the working efficiency of the rotary press, a said remaining roll of paper may be removed and may be replaced with a fresh roll of paper each time a given production printing lot is terminated. This, however, obviously results in an increase in the running cost of the rotary press since it is to make a remaining roll of paper useless each time a given production printing lot has been performed.

Also, in an attempt to prevent a lowered working efficiency of the rotary press and yet to eliminate the wasteful use of a roll of paper, a method may be conceivable in which each time a given production printing lot has been performed the amount of a remaining roll of paper is recorded and stored, a number of such an operations are repeated, whereafter each time a given production printing lot is to be performed a remaining roll of paper that is commensurate with a printing number in that production printing lot is selected from the stored number of remaining roll of paper. However, a stored remaining roll of paper may not be available that is commensurate with a printing number in a production printing lot to be performed. In addition, there remain various amounts of remaining rolls of paper after various productions printing lots. This requires a lot of spaces for storing them and in turn a lot of management efforts. Also, it has not been avoidable for a remaining roll of paper, if stored in a long period of time, to be discolored and to have to be disposed of.

On the other hand, a rotary press as shown in the latter publication (Japanese Unexamined Patent Publication No. Hei 3-70935) in the prior art has taken the construction in which a part of a plurality of paper feed units which are provided separately of a plurality of printing units and corresponding respectively thereto, may constitute the prior art paper feed mechanism, i.e., a mechanism that can be furnished with a plurality of roll of paper, e.g., a plurality of fresh rolls of paper, of a given diameter and permit them to be successively joined together automatically whereas the rest of the paper feed units may be replaced with a mechanism that can be furnished only with a single roll of paper of the above mentioned predetermined diameter so that one roll of paper may not be automatically joined with another.

And, in such a rotary press, it should be noted that each time a given production printing lot has been terminated, a paper feed unit that can be furnished only with a single roll of paper will have a roll of paper of a diameter smaller than the said predetermined diameter removed and a new roll of paper of the said predetermined diameter replaced therefor in order to carry out a next given production printing lot. Also, a partly used roll of paper of a diameter smaller than the said predetermined diameter may, instead of a roll of paper of the said predetermined diameter, be furnished on a paper feed unit with a mechanism that can accept a plurality of roll of papers of the predetermined diameter and that has the ability to automatically join one of them with another, and may carry out a said next given production printing lot while continuing such an automatic joining operation by the maximum time period until the roll of paper of the predetermined diameter having been furnished on the above mentioned paper feed unit that can be furnished only with a single roll of paper is used up.

By doing so, with a partly used roll of paper of a diameter smaller than the predetermined diameter, it becomes possible to eliminate a temporary stop of the rotary press that occurs when a partly used roll of paper has been used up and hence to prevent a drop in the operating efficiency of the rotary press due to such a stop. Also, it then becomes unnecessary to record the remaining amount of a partly used roll of paper that results each time any given production printing lot has been terminated, or to store that partly used roll of paper and yet allows the same to be utilized effectively without entailing any waste of it whatsoever, an advantage that cannot be gained otherwise.

It should be noted, however, that a rotary press as shown in the above mentioned latter publication in the prior art merely represents a relatively large sized conventional rotary press with printing units and paper feed units provided corresponding respectively thereto separate thereof in which a part of the paper feed units is altered from the conventional mechanism with the ability to join a plurality of sheets of paper together automatically to a mechanism that is also conventional without any such automatic paper joining ability.

Therefore, the latter rotary press, though it as a whole has the ability to reduce the space in which a roll of paper is furnished by an amount in which the number of roll of paper acceptable is reduced in a paper feed unit with no paper joining ability, does not in any way bring about any change whatsoever in the area of installation possible while merely making a pair of large and small spaces available for paper feed units, and does not provide any advantage at all for the rotary press to be saved in space or to be small sized. In short, it with much difficulty of adopting, for a part of paper feed units, a mechanism having no automatic paper joining ability, has been nothing but what might barely reduce the manufacturing cost a little and thus only by that reduce the cost of installation.

It is, accordingly, an object of the present invention to eliminate the above mentioned disadvantages in the prior art represented by the foregoing two publications. A further object of the present invention is, with the fact taken into account that a roll of paper that must be automatically joined with another roll of paper is a partly used roll of paper that results from a given production printing lot with a roll of paper of a predetermined diameter, that is, a roll of paper of a diameter smaller than the said predetermined diameter, to prevent a rotary press from being large sized and to provide a rotary press that is small sized and simple, having a printing unit equipped with an automatic paper joining mechanism.

SUMMARY OF THE INVENTION

In order to achieve the objects mentioned above, there is provided in accordance with the present invention, in a first general aspect thereof, a rotary press having a plurality of printing units each of which is capable of printing with a printing cylinder on a paper web that is drawn out of a single roll of paper of a predetermined diameter which is supported on a frame on which is supported the said printing cylinder, in which: there is provided a space which is substantially identical to a space that is needed to accommodate the said single roll of paper of the predetermined thickness in each of one half or less of the said plurality of printing units; there is provided, in the said substantially identical space, a means for supporting a plurality of rolls of paper each with a diameter that is smaller than the said predetermined diameter, the said means being operable so that the said plurality of rolls of paper may be joined together in succession automatically; and further there is provided in the said substantially identical space and at a site that is adjacent thereto a means supported on the said supporting means for joining the said plurality of roll of paper together in succession automatically.

The present invention also provides, in a second general aspect thereof, a rotary press having a plurality of printing units each of which is capable of printing with a printing cylinder on a paper web that is drawn out of a single roll of paper of a predetermined diameter which is supported on a frame on which is supported said printing cylinder, in which: there is provided a space which is substantially identical to a space that is needed to accommodate the said single roll of paper of the predetermined diameter, in each of one half or less of the said plurality of printing units; there is provided a means for supporting, in the said substantially identical space, a plurality of rolls of paper each with a diameter that is smaller than the said predetermined diameter, the said means being operable so that the said plurality of rolls of paper may be jointly supported and may be automatically joined together in succession; there is further provided, in the said substantially identical space and at a site that is adjacent thereto, a means supported on the said supporting means for automatically joining the said plurality of roll of paper together in succession; and the said supporting means comprises: a support shaft disposed on the said frame so as to be rotatable, a plurality of support arms extending radially from the said support shaft and positioned at equi-spaced locations around the said support shaft, the said support arms being arranged so as to be rotatable jointly with the said support shaft and arranged in a pair facing each other in an axial direction of the said support shaft, and a pair of support members which are disposed at a site in a said support arm which site is remote from a center of the said support shaft by a distance which is equal to one half of a sum of the said predetermined diameter and a diameter of the said support shaft so as to support the said roll of paper smaller in diameter, rotatably and in parallel to the said support arm.

Of the said plurality of printing units, those each of which is not provided with an automatic paper joining mechanism will each be furnished with a roll of paper, e.g., a single fresh roll of paper, of a predetermined diameter whereas those each of which is provided with an automatic paper joining mechanism will each be furnished with a plurality of roll of paper of a appropriate diameter which is smaller than the said predetermined diameter, e.g., a roll of paper with a diameter which is one half of the said predetermined diameter, and then a printing operation will be continued by a maximum time period until the said roll of paper of the predetermined diameter is used up.

During this printing operation, a said printing unit that is provided with the said automatic paper joining unit will, as a said roll of paper of a diameter smaller than the said predetermined diameter is consumed, allow sheets of paper to be joined together with a predetermined timing taken. An antecedent partially used roll of paper which becomes unnecessary because of the paper joining action will be removed from the printing unit and will be replaced therein with a roll of paper of a diameter which is smaller than the said predetermined diameter to prepare for a next automatic paper joining action. And, such a printing unit as provided with the said automatic paper joining mechanism will, during a printing operation, be subjected to the automatic paper joining action, the removal of a partially used roll of paper and the furnishing with a roll of paper, repetitively.

And, a roll of paper of a diameter smaller than the said predetermined diameter to be furnished on a said printing unit that is provided with the said automatic paper joining mechanism will be constituted by a partially used roll of paper which comes from a said printing unit that is not provided with an automatic paper joining mechanism after a given printing operation has been carried out therein.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention but to facilitate an explanation and understanding thereof.

In the accompanying drawings.

BEST MODES FOR CARRYING OUT THE INVENTION

Hereinafter, suitable embodiments of the present invention with respect to a rotary press will be set forth with reference to the accompanying drawings hereof.

Figure 1:
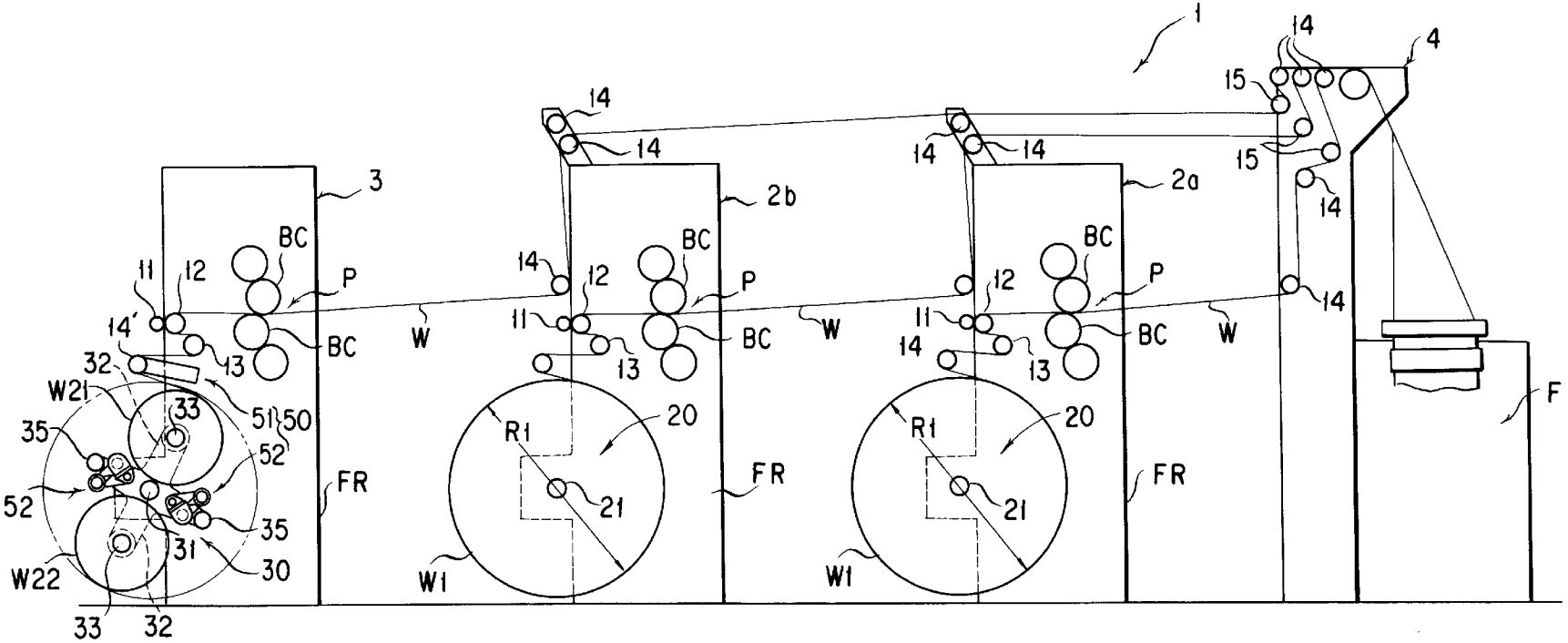
FIG. 1 is a side cross sectional view schematically showing a typical form of embodiment of a rotary press that constitutes the present invention.
Figure 2:
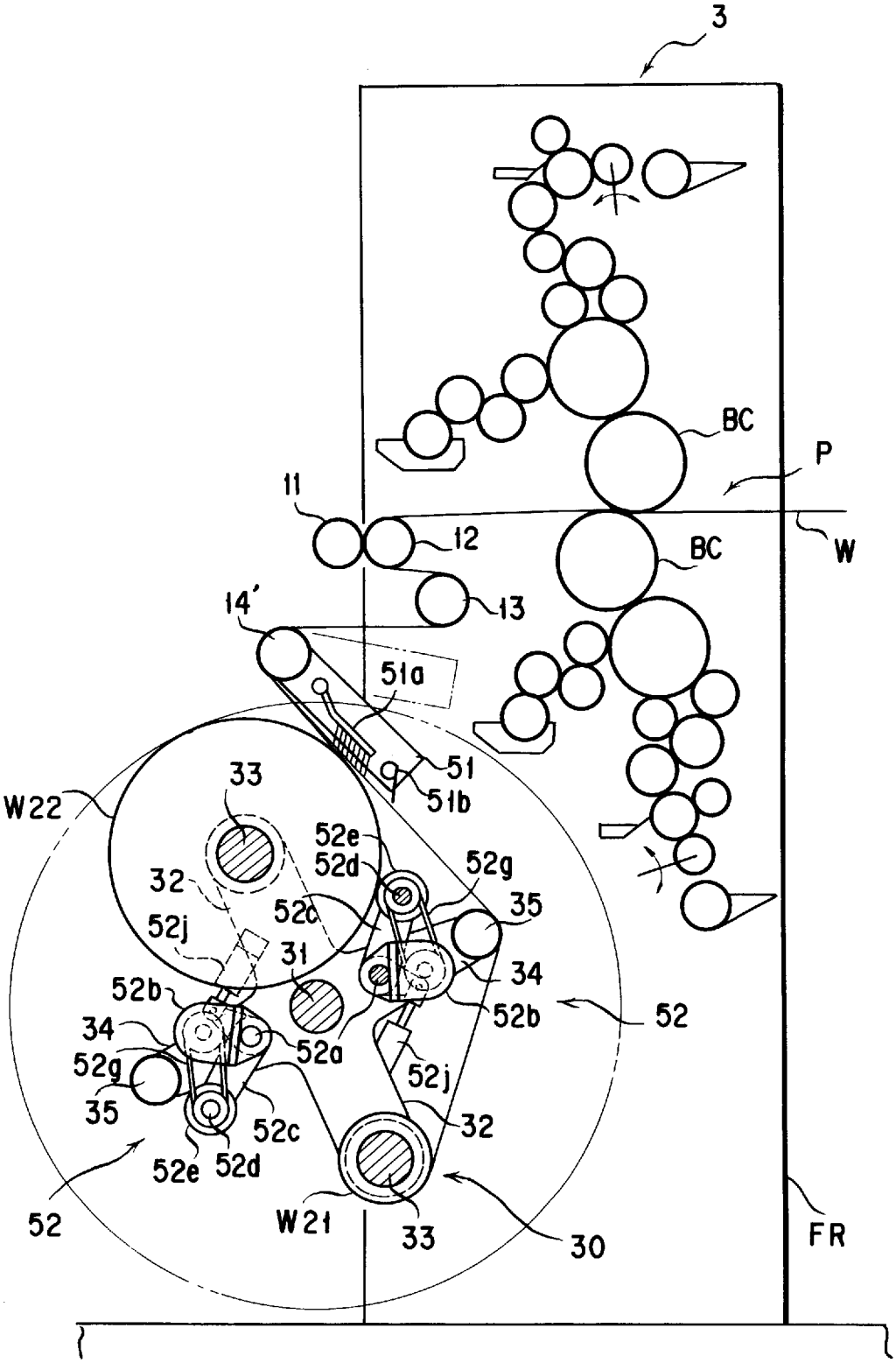
FIG. 2 is a side cross sectional view that shows a printing unit which is provided with an automatic paper joining means in the rotary press that is shown in FIG. 1.
Figure 3:
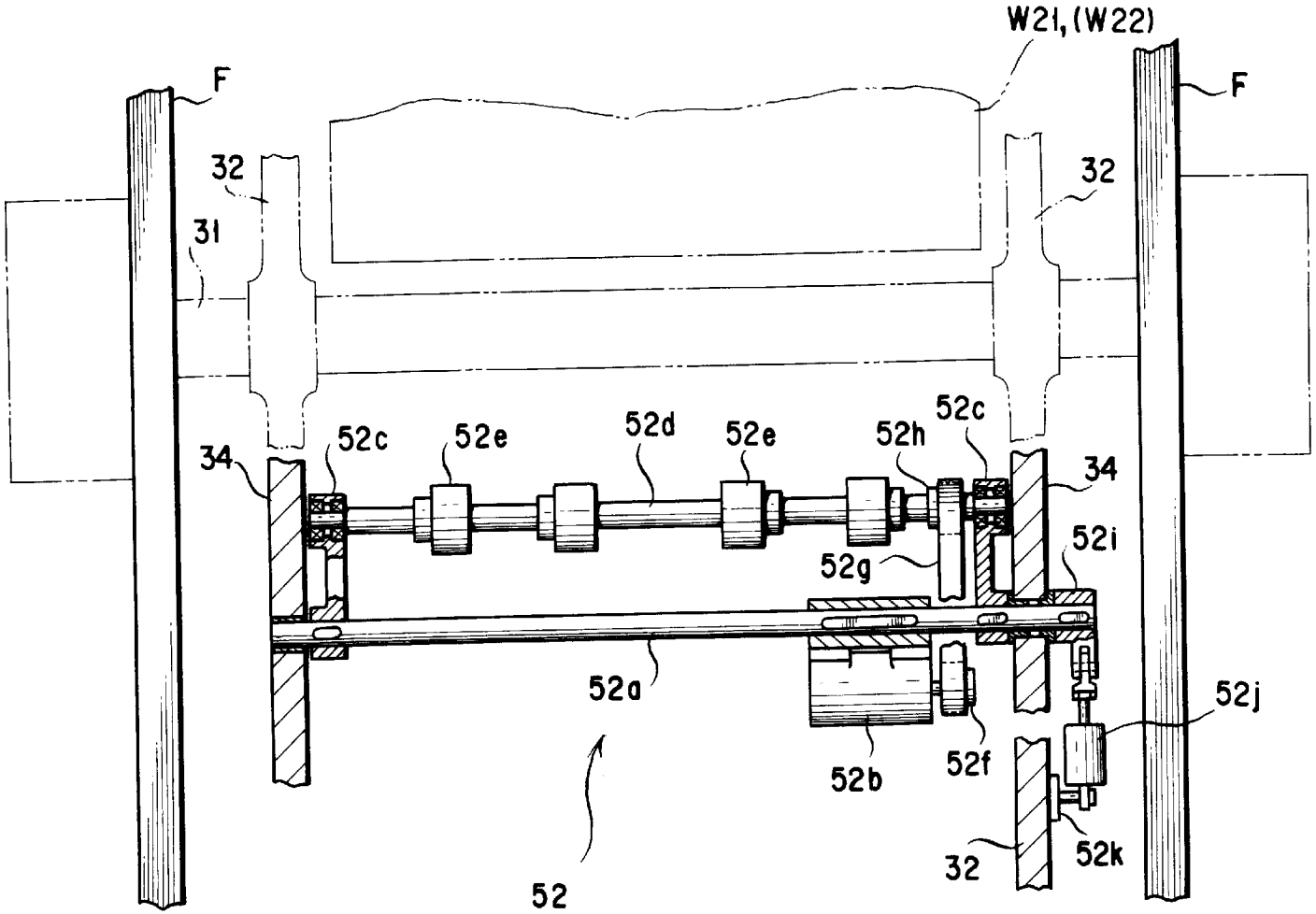
FIG. 3 is a parallel view that shows a preliminary drive mechanism for rotationally driving a roll of paper to be jointed with a traveling sheet of paper being consumed in the automatic paper joining means that is shown in FIG. 2.

FIG. 1 is a side cross sectional view schematically showing a typical form of embodiment of a rotary press that constitutes the present invention; FIG. 2 is a side cross sectional view that shows a printing unit which is provided with an automatic paper joining means in the rotary press that is shown in FIG. 1; and FIG. 3 is a parallel view that shows a preliminary drive mechanism for rotationally driving a roll of paper to be jointed with a traveling sheet of paper being consumed in the automatic paper joining means that is shown in FIG. 2.

A rotary press 1 shown in FIG. 1 comprises three printing units each of which includes a pair of printing cylinders BC and BC for printing on both surfaces of a paper web W at a printing stage P. The said three printing units comprises a first and a second printing unit 2*a* and 2*b* each having a means 20 that is capable of supporting a roll of paper W1, e.g., a fresh roll of paper, of a predetermined diameter R1. The said roll of paper W1 will hereinafter be referred to as a "large diameter paper roll W1". The said three printing units further includes a third printing unit 3 that has, like the first and second printing units 2*a* and 2*b*, an identically constructed printing stage P comprised of a pair of printing cylinders BC and BC and that is provided with a means 30 which is capable of supporting a pair of roll of paper W21 and W22 each of a diameter that is smaller than (e.g., one half of) the said predetermined diameter R1. The said roll of papers W21 and W22 will hereinafter be referred to each as a "small diameter paper roll W21, W22". The said third printing unit 3 also is equipped with an automatic paper joining means 50 and the said rotary press 1 further includes a folding unit 4. It should be noted at this point that each of the said first and second printing units 2*a* and 2*b* is not equipped with any such automatic paper joining means 50.

Each of the above mentioned printing units 2*a*, 2*b* and 3 is designed to pull a paper web W out of the said paper roll W1, W21, W22 supported respectively thereby and to guide it via an infeed roller 12 with a nip roller 11 into between the said printing cylinders BC and BC where the paper web W will be printed on both surfaces thereof.

Also in the above mentioned printing units 2*a*, 2*b* and 3, the said large diameter paper roll support means 20 and 20 and the said small diameter paper roll support means 30 are provided with braking mechanisms (not shown), respectively, which are each designed to regulate a free rotation of the said large diameter paper roll W1, the said small diameter paper roll W21, W22 supported respectively thereon. It should be noted here that such a braking mechanism is adapted to control a tension acting on the traveling paper web W by increasing or decreasing a braking force applied thereby depending on the position of a floating roller 13 designed to be variably located in accordance with a change in the said tension on the traveling paper web W.

Each of the said paper web W (W1, W21 and W22) which have been printed between the said respective pairs of printing cylinders BC and BC of the said printing units 2*a*, 2*b* and 3 will be guided via a series of guide rollers 14 into the said folding unit 4 where they will be cut and folded. Their cutting portions in folding unit 4 will be adjusted by their respective adjust rollers 15 so as to be commensurate with their respective printed image positions.

The respective large diameter paper roll support means 20 and 20 in the said first and second printing units 2*a* and 2*b* are each adapted so as to be capable of being mounted on and dismounted from a frame FR and, when mounted, be rotatable. And, each of them is provided with a rotary support shaft 21 that can be secured to a central bore of the said large diameter paper roll W1 by being pushed against its internal wall in the state it is inserted into the said central bore and a brake mechanism (not shown) that may be coupled to the said rotary support shaft 21 when the latter is mounted on the said frame FR for regulating a free rotation of the said large diameter paper roll W1 via the said rotary support shaft 21.

The small diameter paper roll support means 30 of the said third printing unit 3 is supported by the said frame FR so as to be rotatable, and is provided with a support shaft 31 that is adapted to be rotationally driven in synchronism with the operation of a said automatic paper joining means 50 to be described later and a pair of support arm 31 which are juxtaposed with each other in the direction of the said support shaft 31 and each of which is arranged to extend radially of the said support shaft 31, located so as to divide a space around the said support shaft 31 into two and disposed so as to be rotatable jointly with a rotation of said support shaft 31.

Now, a further explanation will be given in some detail of the small diameter paper roll support means 30 of the said third printing unit 3 with reference to FIGS. 1 and 2. Each of the said support arms 32 is provided at a location that is remote from the center of the said support shaft 31 by a distance which is a sum of one fourth of the predetermined diameter R1 and one fourth of the diameter of the support shaft 31 with a pair of paper roll support members 33 each having a diameter which is less than one half of the said predetermined diameter R1 for supporting the one small diameter paper roll W21 and the other small diameter paper roll W22, respectively, between the said pair of support arms 32 and 32 which are juxtaposed with each other. The said paper roll support members 33 and 33 are disposed to allow the said small diameter paper rolls W21 and W22 to be supported to be in parallel to the said support axis 31 by means of the said pair of support arms 32 and 32 which are juxtaposed with each other. In addition, they each have a brake mechanism (not shown) coupled thereto for regulating a free rotation of each of the said small diameter paper rolls W21 and W22. For the said brake mechanism, it should be noted that since the said small diameter paper roll W21, W22 whose rotation is controlled thereby is smaller in both diameter and inertia than the said large diameter paper roll 31, one that is sufficiently large in braking force but sized smaller and more simplified than a brake mechanism for regulating the free rotation of the said large diameter paper roll W1 may be sufficiently effective.

Also, the said support shaft 31 is provided with a pair of auxiliary arms 34 and 34 which are juxtaposed with each other in an axial direction thereof in such a manner that they may be rotatable jointly therewith. And, by means of the said pair of auxiliary arms 34 and 34 which are so juxtaposed with each other, a pair of guide rollers 35 and 35 are supported at locations each of which is remote from the center of the said support shaft 31 by a suitable distance so that they may lie in parallel with the said support shaft 31.

The said automatic paper joining means 50 in the third printing unit 3 is adapted to thrust a paper web W that has been drawn out of the one small diameter paper roll W21 and is then traveling, against the periphery of the other small diameter paper roll W22, and is thus provided with a thrusting mechanism 51*a* having, e.g., a thrusting brush as well as a paster arm mechanism 51 which is equipped with a cutting mechanism 51*b* having a cutter for cutting the paper web W that has been drawn out of the one small diameter paper roll W21 and is then traveling, immediately after a new paper web W has been drawn out of the other small diameter paper roll W22 by a paper joining action.

The said paster arm mechanism 51 is supported on the center of rotation of a guide roller 14' that is mounted to the said frame FR via a bracket (not shown) or in the vicinity thereof so that its one end may be angularly displaceable. It is adapted to be driven by a drive means (not shown) to assume a suitable angular displacement.

Also, the said automatic paper joining means 50 is constructed of a preliminary drive mechanism 52, to be described later, for rotationally driving the other small diameter paper roll W22 and matching its peripheral speed with a traveling speed of a paper web W that is traveling after it has been drawn out of the said one small diameter paper roll W21, and several detecting means for controlling the operation of the automatic paper joining means 50, including, for example, a paper roll diameter detecting means (not shown) for detecting an instant at which the one paper roll W21 of which the paper web W is being pulled out has had a predetermined diameter for the joining purpose, a speed detecting means (not shown) for detecting the peripheral speed of the other small diameter paper roll W22 rotationally driven to be joined, and so forth.

As shown in FIGS. 2 and 3, the said preliminary drive mechanism 52 will be displaced in accordance with an angular displacement of a through shaft 52*a* that is mounted to the said pair of auxiliary arms 34 and 34 so as to be in parallel to the said support shaft 31 and to be angularly displaceable. For example, it is provided with a rotary drive member 52*b* that may be an electric motor, a pair of arms 52*c* and 52*c* which are juxtaposed with each other in the axial direction of the said through shaft 52*a* and are displaced in accordance with an angular displacement, a rotary shaft 52*d* that is in parallel to the said through shaft 52*a*, is rotatable and is supported by the said arms 52*c* and 52*c*, and a series of small rings 52*e*, 52*e*, . . . which are suitably mounted on the said rotary shaft 52*d* and are rotated jointly therewith. And, the said small rings. 52*e*, 52*e*, . . . are adapted to be capable of making and breaking a contact with the said other small diameter paper roll W22 to be joined in accordance with an angular displacement of the said through shaft 52*a*.

Also in the said preliminary drive mechanism 52, the output shaft of the said rotary drive member 52*b* and the said rotary shaft 52*d* are coupled together via transmission mechanism that comprises, for example, a toothed pulley 52*f*, a toothed belt 52*g* and a toothed pulley 52*h*. Further, the said through shaft 52*a* is coupled to the output rod of a fluid pressure operated cylinder 52*j* via an arm 52*i* which is attached thereto so that it may be angularly displaceable integrally with the through shaft 52*a* and may be angularly displaced by an extension and a retraction of the said output rod. The said fluid pressure operated cylinder 52*j* which may, for example, be an air cylinder is mounted to an above mentioned support arm 32 via an attachment member 52*k*.

A said rotary press 1 having the above mentioned construction will operate as set forth below.

A printing operation will be carried out in the state in which the said first, second and third printing units 2*a*, 2*b* and 3 have been connected to the said folding unit 4 with respective sheets of paper. Thus, the said paper web W, W and W will be pulled out of the said large diameter paper rolls W1 and W1 supported by the said large diameter paper roll supporting means 20 and 20 in the said first and second printing units 2*a* and 2*b*, and the said one small diameter paper roll W21 supported by the said small diameter paper roll supporting means 30 in the said third printing unit 3, respectively.

If the said paper roll diameter detecting means (not shown) detects that the said one small diameter paper roll W21 which is supported by the said small diameter paper roll support means 30 in the said third printing unit 3 and from which the said paper web W is being pulled out has its diameter reduced to a preselected diameter that is suitable for joining, the said support shaft 31 will be rotationally driven in the clockwise direction in FIG. 1 to change the said support arms 32 and the said auxiliary arms 34 from their state shown in FIG. 1 to their state shown in FIG. 2. Thus, the said other small diameter paper roll W22 will be stopped at a position that is slightly removed from the said paper web W that is traveling while it is being pulled out of the said one small diameter paper roll W21.

Next, the output rod of the said fluid pressure operated cylinder 52*j* will be extended to angularly displace the said through shaft 52*a* to push the said series of small rings 52*e*, 52*e*, . . . which are mounted on the said rotary shaft 52*d* against the peripheral surface of the said other small diameter paper roll W22. It should be noted at this point that the said other small diameter paper roll W22 is provided at its pulling end for the paper web W with a sticking stage (not shown) for paper joining, except for its portion corresponding to an area in which the above mentioned small rings 52*e*, 52*e*, . . . are pushed.

If the said small rings 52*e*, 52*e*. . . are pushed against the peripheral surface of the said other small diameter paper roll W22, the said rotary drive member 52*b* will be operatively rotated to rotationally drive the said other small diameter paper roll W22 and then to gradually increase the peripheral speed of the latter so that it may be matched with the traveling speed of the paper web W being drawn out of the said one small diameter paper roll W21.

Then, since the said other small diameter paper roll W22 is smaller in diameter, it will be rotationally driven sufficiently with a smaller force so that the said rotary drive member 52*b* may be small sized and may be large in energy saving. Also, while the said other small diameter paper roll W22 is being rotationally driven, the said paster arm mechanism 51 will be angularly displaced at a standby position shown by the two dot chain line in FIG. 2 to an operative position shown by the solid line in FIG. 2.

If the said speed detecting means (not shown) detects that the peripheral speed of the said other small diameter paper roll W22 is matched with the traveling speed of the paper web W that is traveling while it is being pulled out of the said one small diameter paper roll W21, the thrusting mechanism 51*a* and the cutting mechanism 51*b* of the said paster arm mechanism 51 will be operated in succession each by taking a proper timing so that the paper web W which is traveling while it is being pulled out of the said one small diameter paper roll W21 may first be pushed against the peripheral surface of the said other small diameter paper roll W22, may be pasted onto the pulling end of the said other small diameter paper roll W22 in the said sticking stage (not shown) for paper joining, and may thereafter be cut.

This will allow a printing operation to be effected on the paper web W that is being pulled out of the said other small diameter paper roll W22 in the said third printing unit 3.

Also, after the above mentioned cutting mechanism 51*b* is operated, the said fluid pressure operated cylinder 52 will be retracted to allow the said small rings 52*e*, 52*e*, . . . to be removed from the peripheral surface of the said other small diameter paper roll W22, and further the said rotary drive member 52*b* to be stopped and eventually the said small rings 52*e*, 52*e*, . . . to cease rotating. In a similar manner, after the said cutting 51*b* is operated, the said paster arm mechanism 51 will be returned to the said predetermined standby position by taking a proper timing.

After the said paster arm mechanism 51 has been returned to the said standby position, the said support shaft 31 will be rotationally driven in the clockwise direction in FIG. 2 to cause the said support arms 32 and the said auxiliary arms 34 to be displaced to the positions shown in FIG. 1.

At a proper time until or after the above mentioned displacement is completed, a paper roll with a sheet of paper remaining on the said small diameter paper roll W21 will be removed from a said paper roll support member 33 of the support arm 32 and will be replaced by a new paper roll for the said small diameter paper roll.

During a printing operation, when an automatic paper joining action becomes again necessary in the said third printing unit 3, this will be carried out by performing a series of operating steps. Thus, an automatic paper joining action will be repeated to the necessary extent.

Even while the above mentioned automatic paper joining operation is being performed in the said third printing unit 3, the said rotary press 1 will continue, without interruption, a given printing operation, which should be continued until the said large diameter paper rolls W1 and W1 in the said first and second printing unit 2*a* and 2*b* have been used up, unless any separate trouble develops.

As set forth in the foregoing description, with a rotary press according to the present invention, it should be noted that since a printing unit is provided in which in a space that is required to accommodate a single large diameter paper roll of a predetermined diameter there are accommodated a plurality of (e.g. a pair of) small diameter paper rolls of a diameter that is smaller than the said predetermined diameter, e.g., a diameter that is one half of the said predetermined diameter and in which there is also provided an automatic paper joining mechanism, in addition to other printing units each of which is adapted to accommodate such a single large diameter paper roll of the said predetermined diameter, a said printing unit that accommodates the said large diameter paper roll of the predetermined diameter alone is available for printing thereon whereas a said printing unit furnished with such an automatic paper joining capability is available to accommodate such small diameter rolls as have been partially consumed in the said other printing units, thus making it possible for the rotary press to proceed with a given printing operation continuously while automatically joining one partially consumed sheet of paper with another in succession.

Accordingly, it can be seen that if a printing operation is carried out while accommodating partially consumed roll of paper, there can be no occasion in which a roll of paper may have been used up before a given printing number is completed, thus enhancing the working efficiency of a rotary press. Also, since partially consumed small diameter paper rolls can be effectively used by joining one with another in succession, there will be only a small space required to store partially consumed small diameter paper rolls, and only a little effort will be required for such a storage. In addition, a wasteful need to discard a partially consumed roll of paper with no further use can be completely eliminated. It should also be noted that a printing unit that is designed to accommodate a single large diameter paper roll of a predetermined diameter and a printing unit that is furnished with an automatic paper joining capability can be identical to each other in terms of the space of installation required. Accordingly, in a rotary press having only printing units each of which is designed to accommodate a single large diameter paper roll of a predetermined diameter, any suitable of one or more of these printing units can readily be replaced with a printing unit or units capable of automatically joining one partially consumed paper roll with another in succession.

In addition, if a rotary press is constructed having in a suitable mixture both a printing unit that is designed to accommodate a single large diameter paper roll of a predetermined diameter and a printing unit that is furnished with an automatic paper joining capability, the spacing between adjacent printing units may be made constantly, whereupon their operating spaces can similarly be secured. Besides, if the number of printing units is the same, a rotary press comprised thereof can be installed on the same area of installation, regardless of a proportion of printing units each having an automatic paper joining function.

Furthermore, with roll of paper which can be automatically joined with one another being constituted of only partially consumed small diameter paper rolls, only a small braking force will be required and readily controllable. It should also be noted that for a drive source which is required to rotate a roll of paper to be joined, only one that is extremely simple and small sized may be sufficient. In sum, here results a marked ability to save a space and energy, to ensure a structural simplification, and to minimize any operating trouble whatsoever, in a rotary press.

While the present invention has hereinbefore been described with respect to a certain illustrative embodiment thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all the equivalents thereof.

What is claimed is:

1. A rotary press comprising:

a plurality of printing units, each comprising a frame that supports a single, predetermined diametered, roll of an initially new paper web, and a printing cylinder for extracting the paper web from said roll and printing on the paper web;

means for supporting partly used rolls of paper webs having diameters smaller than said predetermined diametered roll, provided in less than or equal to half of said printing units, and within spaces substantially equal to that of said predetermined diametered roll, comprising:

a support shaft, a plurality of even numbered support arms arranged radially about said support shaft, with a constant angular interval between each of said support arms, a supporting member provided on at least one of said support arms, distanced from a center of said support shaft less than half of the distance of said predetermined diametered roll; and means for automatically and sequentially joining said partly used rolls, located within said space substantially equal to that of said predetermined diametered roll, and supported within said means for supporting partly used rolls of paper webs.

2. The rotary press of claim 1, wherein said supporting member is distanced, from the center of said support shaft, a sum of one fourth of the distance of said predetermined deametered roll, and one fourth of a diameter of said support shaft.

* * * * *